United States Patent [19]

Kato et al.

[11] Patent Number: 5,017,448

[45] Date of Patent: May 21, 1991

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 302,300

[22] Filed: Jan. 27, 1989

[30] Foreign Application Priority Data

Jan. 27, 1988 [JP] Japan ..... 63-14576

[51] Int. Cl.[5] ..... G03G 5/087

[52] U.S. Cl. ..... 430/49; 430/96; 430/87

[58] Field of Search ..... 430/87, 49, 96

[56] References Cited

U.S. PATENT DOCUMENTS 4,792,511 12/1988 Kato et al. ..... 430/87

4,828,952 5/1989 Kato et al. ..... 430/87

*Primary Examiner*—John Goodrow

*Attorney, Agent, or Firm*—Sughrue, Mion, Zinn, Macpeak & Seas

[57] ABSTRACT

An electrophotographic lithographic printing plate precursor is described which utilizes an electrophotographic photoreceptor comprising a conductive support having provided thereon at least one photoconductive layer containing photoconductive zinc oxide and a resin binder, wherein said resin binder comprises at least one resin which contains at least one kind of functional group capable of producing at least one carboxyl group through decomposition and is crosslinked at least in part to bring about improvements in background stain resistance and printing durability.

13 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor for producing a printing plate through electrophotography, and, more particularly, to an improvement made in a resin binder constituting a photoconductive layer of said lithographic printing plate precursor.

BACKGROUND OF THE INVENTION

Many kinds of offset printing plate precursors for directly producing printing plates have hitherto been proposed, and some of them have already been put into practical use. The most widely employed precursor among them is a photoreceptor in which a photoconductive layer containing as main components photoconductive particles, such as zinc oxide, and a resin binder is provided on a conductive support, and a highly lipophilic toner image is formed on said layer surface through an ordinary electrophotographic process. The toner image-formed surface of the photoreceptor is then treated with an oil-desensitizing solution, often referred to as an etching solution, to selectively render the non-image areas hydrophilic, and thus produce an offset printing plate.

In order to obtain satisfactory prints, it is required that the offset printing plate precursor of the above-described type have various properties, such that the photoreceptor can faithfully reproduce an original on the surface thereof; the photoreceptor surface should have a high affinity for an oil-desensitizing solution so as to render non-image areas sufficiently hydrophilic, and, at the same time, should have water resistance; and when used as printing plate, the photoconductive layer having a toner image formed thereon should not come off during printing, and should be well receptive to dampening water so that the non-image areas can retain a hydrophilic property sufficient to be free from stains even after a large number of prints have been reproduced therefrom.

These properties are already known to depend upon the ratio of zinc oxide to resin binder in the photoconductive layer. Specifically, when the ratio of zinc oxide particles to resin binder in the photoconductive layer is decreased, the oil-desensitivity of the photoconductive layer surface is enhanced and the background stain is lessened, whereas the internal cohesive force of the photoconductive layer itself is lowered to result in deterioration of printing impression through insufficiency of the mechanical strength. On the contrary, when the proportion of resin binder is increased, the background stain is increased though the printing impression is heightened. Thus the background stain in particular is a phenomenon relating to the oil-desensitivity of the photoconductive layer surface. The ratio between zinc oxide and a resin binder in the photoconductive layer does not solely influence the oil-desensitivity, but it has become apparent that the oil-densitivity also depends greatly on the kind of the resin binder employed.

Examples of known resins include silicone resins as disclosed in JP-B-34-6670 (The term "JP-B" as used herein means an "examined Japanese patent publication"), styrene-butadiene resins as disclosed in JP-B-35-1950, alkyd resins, maleic acid resins, polyamides as disclosed in JP-B-35-11219, vinyl acetate resins as disclosed in JP-B-41-2425, vinyl acetate copolymers as disclosed in JP-B-41-2426, acryl resins as disclosed in JP-B-35-11216, acrylic acid ester copolymers as disclosed in JP-B-3511219, JP-B-36-8510, JP-B-41-13946 and so on. However, the electrophotographic photoreceptors using those resins have some problems, in that: (1) the photoconductive layer is low in chargeability; (2) the image reproduced thereon is poor in quality (in particular, dot reproducibility and resolving power); (3) their photoreceptivities are low; (4) even when subjected to an oil-desensitizing treatment for producing an offset master, the photoconductive layer surface acquires only insufficient oil-desensitivity, to result in generation of background stains on the prints when offset printing is performed; (5) the photoconductive layer is insufficient in film strength, so that, e.g., separation occurs upon offset printing, and hence a large number of prints cannot be obtained; (6) the image quality is apt to be influenced by the environment at the time of image reproduction (e.g., high temperature and high humidity condition), and so on.

As for the offset master, the background stain resulting from insufficiency in oil-desensitization is a particularly serious problem. For the purpose of solving this problem various resins have been developed, and examined for the aptitude for the binder of zinc oxide and the possibility of enhancing the oil-desensitivity. As resins having an effect on improvement in oil-desensitivity of the photoconductive layer, JP-B-50-31011 discloses the combination of a resin prepared by copolymerizing a (meth)acrylate monomer and another monomer in the presence of fumaric acid, which has a molecular weight of from $1.8\times10^4$ to $1.0\times10^5$ and a glass transition point (Tg) of from 10° C. to 80° C., with a copolymer prepared from a (meth)acrylate monomer and a monomer other than fumaric acid; JP-A-53-54027 (The term "JP-A" as used herein means an "unexamined published patent application") discloses a ternary copolymer comprising a (meth)acrylic acid ester having a substituent which contains a carboxylic acid group apart from the ester linkage by at least 7 atoms; JP-A-54-20735 and JP-A-57-202544 disclose quaternary or quinary copolymers comprising acrylic acid and hydroxyethyl (meth-)acrylate; and JP-A-58-68046 discloses a ternary copolymer comprising a (meth)acrylic acid ester having an alkyl group containing 6 to 12 carbon atoms as a substituent and vinyl monomer containing a carboxylic acid group. However, even in the cases of using the above-described resins, which are said to have an effect of enhancing the oil-densitivity, the resulting offset masters are still insufficient in resistance to background stain, printing impression, etc., from a practical point of view.

On the other hand, resins of the type which contain functional groups capable of producing hydrophilic groups through decomposition have been examined for an aptitude for the resin binder. For instance, the resins containing functional groups capable of producing hydroxyl groups by decomposition are disclosed in JP-A-62-195684, JP-A-62-210475 and JP-A-62-210476, and those containing functional groups capable of producing carboxyl groups through decomposition are disclosed in JP-A-62-21269.

These patent specifications describe that since the disclosed resins can produce hydrophilic groups by hydrolysis or hydrogenolysis in an oil-desensitizing solution or dampening water used upon printing, the use of those resins as resin binder for lithographic printing plate precursors can not only evade suffering from various problems (including the aggravation of surface smoothness, the deterioration of electrophotographic characteristics and so on) which are thought to be caused by the strong interaction between hydrophilic groups and the surfaces of photoconductive zinc oxide particles when resins originally containing hydrophilic groups themselves are used as the resin binder, but also produce such an effect that the affinity of the nonimage part (which is rendered hydrophilic by an oil-desensitizing solution) for water is further strengthened by the aforesaid hydrophilic groups produced by the decomposition in the resins, to make a clear distinction between the lipophilic image part and the hydrophilic nonimage part, and, at the same time, to prevent printing ink from adhering to the nonimage part upon printing, and thereby to enable the printing of a large number of clear prints free from background stains.

Even those resins, however, do not yet succeed in realizing substantial prevention of background stain and satisfactory printing impression. Specifically, it turned out that when such a resin as to contain hydrophilic group-producing functional groups is used in an increased amount with the intention of further improving the affinity of the nonimage area for water, the question arose as to durability of the resulting printing plate, because the hydrophilic groups produced by decomposition come to rendering the nonimage area soluble in water while increasing the affinity for water.

Accordingly, methods of further enhancing the effects of the affinity of the nonimage area for water, and, at the same time, further heightening the durability have been awaited.

SUMMARY OF THE INVENTION

The above-described points have been found to be solved by an electrophotographic lithographic printing plate precursor which utilizes an electrophotographic photoreceptor comprising a conductive support having provided thereon at least one photoconductive layer containing photoconductive zinc oxide and a resin binder, with the resin binder comprising at least one resin of the kind which contains at least one kind of functional group capable of producing at least one carboxyl group through decomposition, and is at least partially crosslinked, thus achieving this invention.

This invention is characterized by the resin binder constituting the photoconductive layer of a lithographic printing plate precursor, which contains at least one kind of functional group capable of producing at least one carboxylic group by being decomposed, and at least a part of which is crosslinked. According to this invention, therefore, the lithographic printing plate precursor has advantages in that it reproduces copies faithful to an original, does not generate background stains owing to a strong affinity of the nonimage part for water, is excellent in smoothness and electrostatic characteristics of the photoconductive layer, and further has prominent printing impression.

Moreover, the lithographic printing plate precursor of this invention has merits in that it does not undergo adverse environmental influences during the processing for plate-making, and also has excellent keeping quality before it is subjected to such processing.

DETAILED DESCRIPTION OF THE INVENTION

Resins containing at least one kind of functional group capable of producing at least one carboxyl group through decomposition (which are simply called resins containing carboxyl group-producing functional groups, at times hereinafter), which are used in this invention, are described in further detail below.

Functional groups contained in the resins to be used in this invention produce carboxyl groups through decomposition, and the number of carboxyl groups produced from one functional group may be one or more.

In accordance with a preferred embodiment of this invention, the resins containing carboxyl group-producing functional groups are those containing at least one kind of functional group represented by formula (I):

$$-COO-L_1 \qquad (I)$$

In the foregoing formula $-COO-L_1$, $L_1$ represents

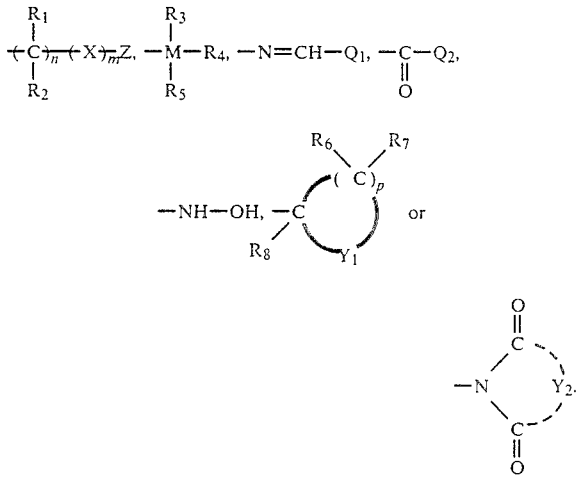

Therein, $R_1$ and $R_2$ (which may be the same or different) each represents a hydrogen atom or an aliphatic group; X represents an aromatic group; Z represents a hydrogen atom, a halogen atom, a trihalomethyl group, an alkyl group, —CN, $-NO_2$, $-SO_2R_1$, (wherein $R_1$, represents a hydrocarbon group, $-COOR_2$, (wherein $R_2$, represents a hydrocarbon group), or $-O-R_3$, (wherein $R_3$, represents a hydrocarbon group); n and m are each 0, 1, or 2; $R_3$, $R_4$, and $R_5$ (which may be the same or different) each represents a hydrocarbon group, or $-O-R_4$, (wherein $R_4$, represents a hydrocarbon group; M represents Si, Sn, or Ti; $Q_1$ and $Q_2$ each represent a hydrocarbon group; $Y_1$ represents an oxygen atom, or a sulfur atom; $R_6$, $R_7$, and $R_8$ (which may be the same or different) each represents a hydrogen atom, a hydrocarbon group, or $-O-R_5$, (wherein $R_5$, represents a hydrocarbon group); p represents an integer of 3 or 4 ; and $Y_2$ represents an organic residue to complete a cyclic imido group.

The above-described hydrocarbon group means an aliphatic group including a chain or cyclic alkyl, alkenyl or aralkyl group, and an aromatic group including a phenyl or naphthyl group, and these hydrocarbons may be substituted.

The functional groups of formula —COO—$L_1$, which produce a carboxyl group through decomposition, are described in greater detail below.

In one case where $L_1$ represents

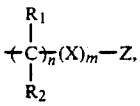

$R_1$ and $R_2$ (which may be the same or different) each preferably represents a hydrogen atom, or an optionally substituted straight or branched chain alkyl group containing 1 to 12 carbon atoms (e.g., methyl, ethyl, propyl, chloromethyl, dichloromethyl, trichloromethyl, trifluoromethyl, butyl, hexyl, octyl, decyl, hydroxyethyl, 3-chloropropyl); X preferably represents an optionally substituted phenyl or naphthyl group (e.g., phenyl, methylphenyl, chlorophenyl, dimethylphenyl, chloromethylphenyl, naphthyl); Z preferably represents a hydrogen atom, a halogen atom (e.g., chlorine, fluorine), a trihalomethyl group (e.g., trichloromethyl, trifluoromethyl), an optionally substituted straight- or branched-chain alkyl group containing 1 to 12 carbon atoms (e.g., methyl, chloromethyl, dichloromethyl, ethyl, propyl, butyl, hexyl, tetrafluoroethyl, octyl, cyanoethyl, chloroethyl), —CN, —$NO_2$, —$SO_2R_1$, [where $R_1$, represents an aliphatic group (e.g., an optionally substituted alkyl group having 1 to 12 carbon atoms, including methyl, ethyl, propyl, butyl, chloroethyl, pentyl, octyl, etc.; an optionally substituted aralkyl group containing from 7 to 12 carbon atoms, including benzyl, phenetyl, chlorobenzyl, methoxybenzyl, chlorophenetyl, methylphenetyl, etc.); or an aromatic group (e.g., an optionally substituted phenyl or naphthyl group, including phenyl, chlorophenyl, dichlorophenyl, methylphenyl, methoxyphenyl, acetylphenyl, acetamidophenyl, methoxycarbonylphenyl, naphthyl, etc.)], or —O—$R_3$, (wherein $R_3$, has the same meaning as $R_1$,); and n and m each represents 0, 1, or 2.

In the case where $L_1$ represents

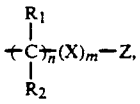

specific examples of such a substituent group include β,β,β-trichloroethyl group, β,β,β-trifluoroethyl group, hexafluoro-iso-propyl group, groups of the formula —$CH_2$—$(CF_2CF_2)_{n'}$H (n'=1-5), 2-cyanoethyl group, 2-nitroethyl group, 2-methanesulfonylethyl group, 2-ethanesulfonylethyl group, 2-butanesulfonylethyl group, benzenesulfonylethyl group, 4-nitrobenzenesulfonylethyl group, 4-cyanobenzenesulfonylethyl group, 4-methylbenzenesulfonylethyl group, unsubstituted and substituted benzyl groups (e.g., benzyl, methoxybenzyl, trimethylbenzyl, pentamethylbenzyl, nitrobenzyl), unsubstituted and substituted phenacyl groups (e.g., phenacyl, bromophenacyl), and unsubstituted and substituted phenyl groups (e.g., phenyl, nitrophenyl, cyanophenyl, methanesulfonylphenyl, trifluoromethylphenyl, dinitrophenyl).

In the case where $L_1$ represents

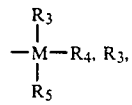

$R_4$, and $R_5$ (which may be the same or different) each preferably represents an optionally substituted aliphatic group containing 1 to 18 carbon atoms [wherein the aliphatic group includes an alkyl group, an alkenyl group, an aralkyl group and an alicyclic group, which each may be substituted, e.g., by a halogen atom, —CN, —OH, —O—Q' (wherein Q' represents an alkyl group, an aralkyl group, an alicyclic group, or an aryl group), etc.], an optionally substituted aromatic group containing 6 to 18 carbon atoms (e.g., phenyl, tolyl, chlorophenyl, methoxyphenyl, acetamidophenyl, naphthyl), or —O—$R_4$, (wherein $R_4$, represents an optionally substituted alkyl group containing 1 to 12 carbon atoms, an optionally substituted alkenyl group containing 2 to 12 carbon atoms, an optionally substituted aralkyl group containing 7 to 12 carbon atoms, an optionally substituted alicyclic group containing 5 to 18 carbon atoms, or an optionally substituted aryl group); and M represents Si, Ti, or Sn, preferably Si.

In other cases where $L_1$ represents —N=CH—$Q_1$ OR —CO—$Q_2$, $Q_1$ and $Q_2$ each represents, preferably, an optionally substituted aliphatic group containing 1 to 18 carbon atoms (wherein the aliphatic group include an alkyl group, an alkenyl group, an aralkyl group and an alicyclic group, which each may be substituted, e.g., by a halogen atom, —CN, an alkoxy group, etc.), or an optionally substituted aryl group containing 6 to 18 carbon atoms (e.g., phenyl, methoxyphenyl, tolyl, chlorophenyl, naphthyl).

In still another case wherein $L_1$ represents

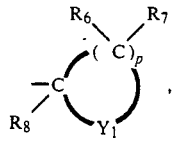

$Y_1$ represents an oxygen atom, or a sulfur atom; $R_6$, $R_7$ and $R_8$ may be the same or different, and each preferably represents a hydrogen atom, an optionally substituted straight- or branched-chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicylic group (e.g., cyclopentyl, cyclohexyl), an optionally substituted aralkyl group containing 7 to 12 carbon atoms (e.g., benzyl, phenetyl, chlorobenzyl, methoxybenzyl), an optionally substituted aromatic group (e.g., phenyl, naphthyl, chlorophenyl, tolyl, methoxyphenyl, methoxycarbonylphenyl, dichlorophenyl), or —O—$R_5$, (wherein $R_5$, represents a hydrocarbon group, including the same groups as those cited as examples of $R_6$, $R_7$, and $R_8$); and p represents an integer of 3 or 4.

In a further case where $L_1$ represents

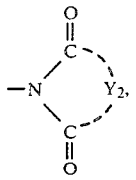

$Y_2$ represents an organic group completing a cyclic imido group. Preferred examples of such a group include those represented by the following formulae (II) and (III).

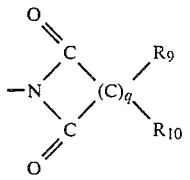

(II)

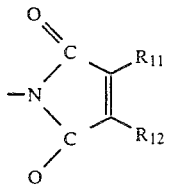

(III)

In formula (II), $R_9$ and $R_{10}$ (which may be the same or different) each represents a hydrogen atom, a halogen atom (e.g., chlorine, bromine), an optionally substituted alkyl group containing 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2(ethoxyoxy)ethyl), an optionally substituted aralkyl group containing 7 to 12 carbon atoms (e.g., benzyl, phenetyl, 3-phenylpropyl, methylbenzyl, dimethylbenzyl, methoxybenzyl, chlorobenzyl, bromobenzyl), an optionally substituted alkenyl group containing 3 to 18 carbon atoms (e.g., allyl, 3-methyl-2-propyl-2-pentenyl, 12-octadecenyl), —S—$R_6$, (wherein $R_6$, represents a substituent group including the same alkyl, aralkyl and alkenyl groups as the foregoing $R_9$ and $R_{10}$ represent, or an optionally substituted aryl group (e.g., phenyl, tolyl, chlorophenyl, bromophenyl, methoxyphenyl, ethoxyphenyl, ethoxycarbonylphenyl)), or —$NHR_7$, (wherein $R_7$, has the same meaning as $R_6$,); and further, the combination of $R_9$ and R10 may form a ring group such as a 5- or 6-membered single ring group (e.g., cyclopentyl, cyclohexyl), or a 5- or 6-membered ring-containing bicyclo ring (e.g., a bicyloheptane ring, a bicycloheptene ring, a bicyclooctane ring, a bicyclooctene ring), which each may be substituted by a group as cited as examples of the foregoing $R_9$ and $R_{10}$.

q represents an integer of 2 or 3.

In the foregoing formula (III), $R_{11}$ and $R_{12}$ (which may be the same or different) each has the same meaning as the foregoing $R_9$ or $R_{10}$. In addition, $R_{11}$ and $R_{12}$ may combine with each other to complete an aromatic ring (e.g., a benzene ring, a naphthalene ring).

In another preferred embodiment, the resin of this invention contains at least one kind of functional group represented by formula (IV).

—CO—$L_2$ (IV)

In the above formula, $L_2$ represents

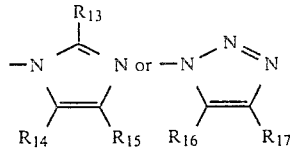

(wherein $R_{13}$, $R_{14}$, $R_{15}$, $R_{16}$ and $R_{17}$ each represents a hydrogen atom, or an aliphatic group).

Preferred examples of such an aliphatic group include those represented by the foregoing $R_6$, $R_7$, and $R_8$. In addition, the combination of $R_{14}$ and $R_{15}$, and that of $R_{16}$ and $R_{17}$, may be an organic group completing a condensed ring, with preferred examples including 5- to 6-membered single rings (e.g., cyclopentene, cyclohexene) and 5- to 12-membered aromatic rings (e.g., benzene, naphthalene, thiophene, pyrrole, pyran, quinoline).

In still another preferred embodiment, the resin of this invention contains at least one kind of oxazolo ring represented by the formula (V).

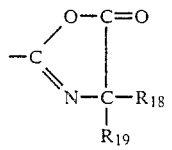

(V)

In the above formula (V), $R_{18}$ and $R_{19}$ may be the same or different, and each represents a hydrogen atom or a hydrocarbon group, or they may combine with each other to form a ring.

Preferably, $R_{18}$ and $R_{19}$ are each a hydrogen atom, an optionally substituted straight- or branched-chain alkyl group containing 1 to 12 carbon atoms (e.g., methyl, ethyl, propyl, butyl, hexyl, 2-chloroethyl, 2-methoxyethyl, 2-methoxycarbonylethyl, 3-hydroxypropyl), an optionally substituted aralkyl group containing 7 to 12 carbon atoms (e.g., benzyl, 4-chlorobenzyl, 4-acetamidobenzyl, phenetyl, 4-methoxybenzyl), an optionally substituted alkenyl group containing 2 to 12 carbon atoms (e.g., ethylene, allyl, isopropenyl, butenyl, hexenyl), an optionally substituted 5- to 7-membered alicyclic ring group (e.g., cyclopentyl, cyclohexyl, chlorocyclohexyl), or an optionally substituted aryl group (e.g., phenyl, chlorophenyl, methoxyphenyl, acetamidophenyl, methylphenyl, dichlorophenyl, nitrophenyl, naphthyl, butylphenyl, dimethylphenyl), or the combination of $R_{18}$ and $R_{19}$ is a group completing a ring (e.g., tetramethylene, pentamethylene, hexamethylene).

The resins containing at least one kind of functional group selected from among those of the general formulae (I) to (V) can be prepared using a method which involves converting carboxyl groups contained in a polymer to the functional group represented by formula —COO—$L_1$ or —CO—$L_2$ according to the polymer reaction, or a method which involves polymerizing one or more of a monomer containing one or more of a functional group of the general formula —COO—$L_1$ or —CO—$L_2$, or copolymerizing one or more of said monomer and other copolymerizable monomers according to a conventional polymerization reaction.

These preparation methods are described in detail in known literatures cited, e.g., in Nihon Kagakukai (ed.), *Shin-Jikken Kaqaku Koza,* vol. 14, "Yuki Kagobutsu no Gosei to Han-no (V)", p. 2535, Maruzen K.K., Yoshio Iwakura and Keisuke Kurita, *Hannosei Kobunshi* (*Reactive High Molecules*), p. 170, Kodansha, Tokyo.

The method of preparing a polymer from monomers previously containing one or more of the functional group represented by the general formula —COO—$L_1$ or —CO—$L_2$ in accordance with a polymerization reaction is preferred, because the functional group(s) of the formula —COO—$L_1$ or —CO—$L_2$ to be introduced into the polymer can be controlled at one's option, the prepared polymer is not contaminated by impurities, and so on. More specifically, the resins of this invention can be prepared by converting carboxyl group(s) contained in polymerizing double bond-containing carboxylic acids or their halides to the functional group of the formula —COO—$L_1$ or —CO—$L_2$ according to some methods described in known literatures as cited above, and then by carrying out a polymerization reaction.

On the other hand, the resins containing oxazolone rings represented by formula (V) can be prepared by polymerizing one or more of a monomer containing said oxazolone ring, or by copolymerizing the monomer of the above-described kind and other monomers copolymerizable with said monomer.

These oxazolone ring-containing monomers can be prepared from N-acyloyl-α-amino acids containing a polymerizing unsaturated double bond through the dehydrating ring-closure reaction. More specifically, they can be prepared using methods described, e.g., in Yoshio Iwakura & Keisuke Kurita, *Hannosei Kobunshi* (*Reactive High Molecules*), chap. 3, Kodansha.

Specific examples of other monomers capable of copolymerizing with the monomers containing the functional groups of this invention include aliphatic carboxylic acid vinyl or allyl esters, such as vinyl acetate, vinyl propionate, vinyl butyrate, allyl acetate, allyl propionate, etc.; esters or amides of unsaturated carboxylic acids, such as acrylic acid, methacrylic acid, crotonic acid, itaconic acid, maleic acid, fumaric acid, etc.; styrene derivatives, such as styrene, vinyltoluene, α-methylstyrene, etc.; α-olefins; acrylonitrile; methacrylonitrile; and vinyl-substituted heterocyclic compounds, such as N-vinylpyrrolidone, etc.

Specific, but not limiting, examples of the copolymer constituent containing the functional group of the general formulae (I) to (V) to be used, as described above, in the method of preparing a desired resin through the polymerization reaction include those represented by formula (VI).

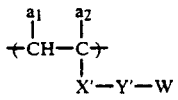

(VI)

wherein X' represents —O—, —CO—, —COO—, —OCO—,

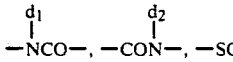

-continued

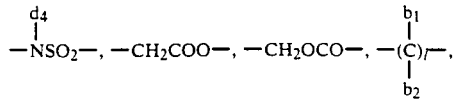

an aryl group, or a heterocyclyl group (wherein $d_1$, $d_2$, $d_3$ and $d_4$ each represent a hydrogen atom, a hydrocarbon group, or the moiety -Y'-W in the formula (VI); $b_1$ and $b_2$ may be the same or different, each being a hydrogen atom, a hydrocarbon residue or the moiety -Y'-W in the formula (II); and l is an integer of from 0 to 18); Y' represents a carbon-carbon bond or chain for connecting the linkage group X' to the functional group -W, between which hetero atoms (including oxygen, sulfur and nitrogen) may be present, which specific examples including

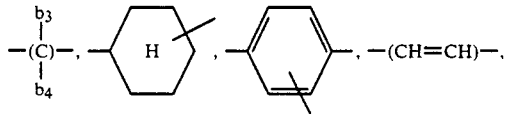

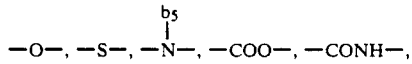

—$SO_2$—, —$SO_2$NH—, —NHCOO—, —NHCONH—or a combination of one or more of these groups (wherein $b_3$, $b_4$ and $b_5$ each have the same meaning as the foregoing $b_1$ or $b_2$); W represents the functional group represented by the formula (I) to (V); and $a_1$ and $a_2$ may be the same or different, each being a hydrogen atom, a halogen atom (e.g., chlorine, bromine), a cyano group, a hydrocarbon residue (e.g., an optionally substituted alkyl group containing 1 to 12 carbon atoms, such as methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl, etc., an aralkyl group such as benzyl, phenetyl, etc., and an aryl group such as phenyl, tolyl, xylyl, chlorophenyl, etc.), or an alkyl group containing 1 to 18 carbon atoms, an alkenyl group, an aralkyl group, an alicyclic group or an aryl group, which each may be substituted by a group containing the functional moiety W in the formula (VI).

In addition, the linkage moiety -X'-Y'- in formula (VI) may directly connect the moiety

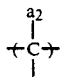

to the moiety W.

W represents the functional group of the formulae (I) to (V).

Specific but non-limiting examples of the functional groups of formulae (I) to (V) (or W in the formula (VI)) are illustrated below.

(1)

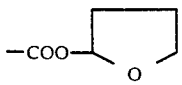

-continued
(2)
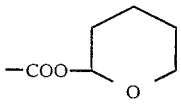
(3)
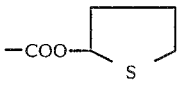
(4)
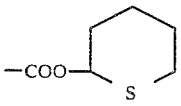
(5)
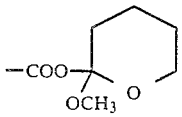
(6)
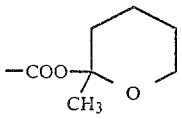
(5)
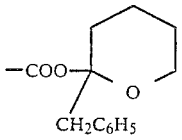
(8)
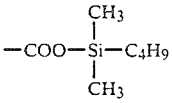
(9)
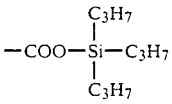
(10)
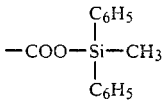
(11)
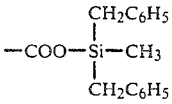
$-COOCH_2CF_3$
(13)
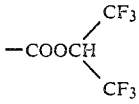
(14)
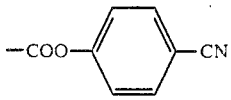
(15)
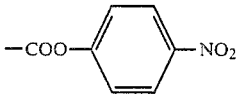
-continued
(16)
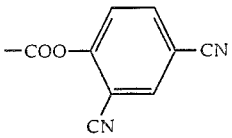
(17)
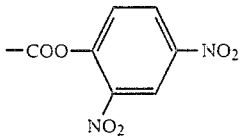
(18)
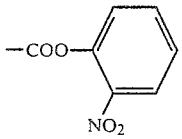
(19)
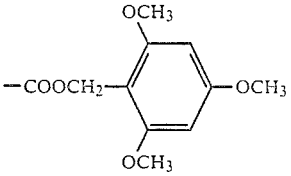
(20)
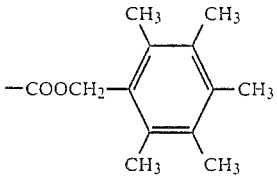
(21)
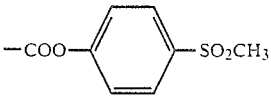
(22)
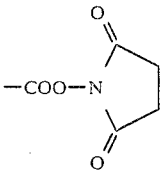
(23)
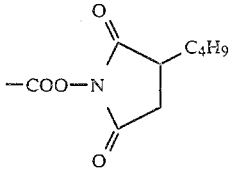
(24)
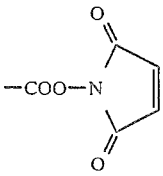
(25)
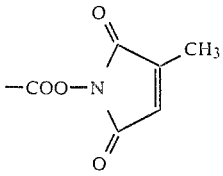

-continued
(26)
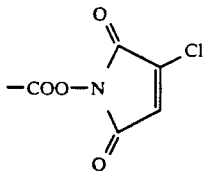
(27)
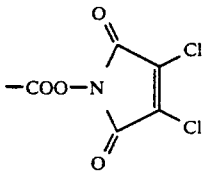
(28)
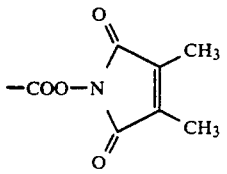
(29)
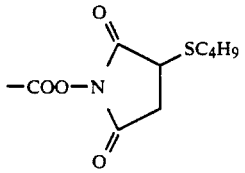
(30)
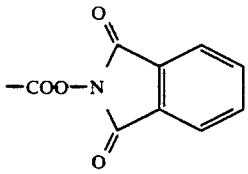
(31)
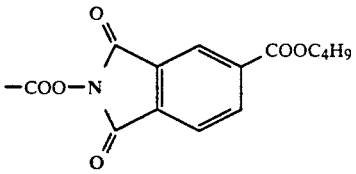
(32)
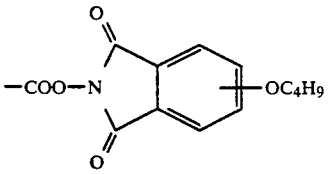
(33)
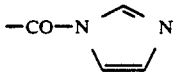
(34)
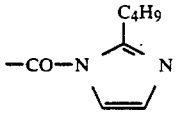
(35)
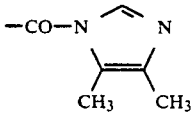
-continued
(36)
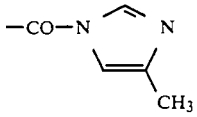
(37)
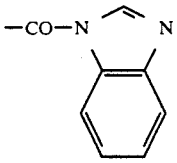
(38)
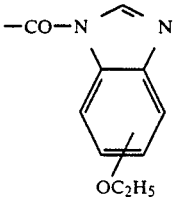
(39)
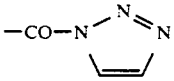
(40)
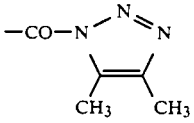
(41)
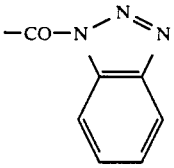
(42)
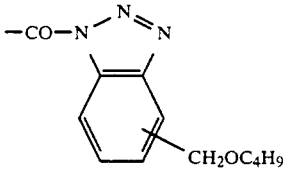
(43)
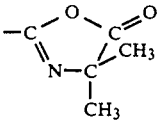
(44)
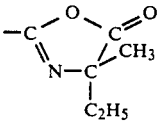
(45)
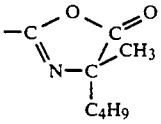
(46)
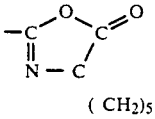

-continued (47)

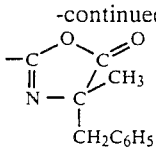

(48) $-COOCH_2OCH_3$ (49)

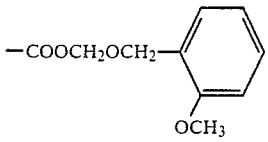

(50) $-COOC(C_6H_5)_3$

(51) $-COOCH(C_6H_5)_2$ (52)

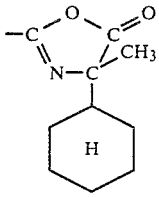

When the resin of the present invention is a copolymer, a preferred proportion of the repeating unit containing a carboxyl group-producing functional group ranges from 1 to 95 wt %, particularly from 5 to 60 wt %, with respect to all units in the copolymer. A suitable molecular weight of the copolymer resin ranges from about $1\times10^3$ to about $1\times10^6$, preferably from $5\times10^3$ to $5\times10^5$, more preferably from $3\times10^4$ to $4\times10^5$.

The resin of the present invention is further characterized by cross-linkages formed at least in part among resin molecules when the resin constitutes an electrophotographic lithographic printing plate precursor.

In order to obtain partial cross-linkage as described above, a previously cross-linked polymer may be used at the stage of coating a photoreceptive layerforming composition during the plate-making process, or a heat and/or light curable resin containing cross-linkable functional groups may be used and cross-linked in the course of producing a lithographic printing plate precursor (e.g., in the drying step), or these resins may be used together.

The amount of a component containing cross-linkable functional groups is preferably from about 0.1 to about 10% by weight, when the cross-linkable groups are copolymer components containing polymerizable double bonds, or from about 1 to about 80% by weight, when the cross-linkable groups are copolymer components containing cross-linkable groups other than the polymerizable double bonds.

In using a resin previously cross-linked in part (i.e., a resin having a cross-linking structure among polymer molecules) as resin binder, the resin preferably should become slightly soluble or insoluble in an acidic or alkaline aqueous solution when the foregoing carboxyl group-producing functional groups contained in the resin are decomposed to produce carboxyl groups.

More specifically, preferred resins have solubilities of 50 g or less, particularly 30 g or less, in 100 g of distilled water at 25° C. The solubility of the resin as defined herein means the solubility after the resin has been subjected to the oil-desensitization treatment.

In introducing a cross-linking structure into polymer molecules of a resin, conventional methods can be employed.

For example, a method of polymerizing monomer(s) in the presence of a polyfunctional monomer can be employed, and a method of introducing functional groups capable of promoting a cross-linking reaction into polymers and cross-linking these polymers by the polymer reaction can be employed.

For the introduction of a cross-linking structure in the resin of this invention, functional groups capable of undergoing a self cross-linking reaction, represented by $-CONHCH_2OR'$ (wherein R' is a hydrogen atom or an alkyl group), or cross-linking reactions through polymerization are effective from the standpoints of the absence of adverse effects upon electrophotographic characteristics and simplicity of preparation (e.g., the reaction is fast, the reaction proceeds stoichiometrically, and contamination with impurities is minimal because no auxiliary agent is used for accelerating the reaction).

The resin of the present invention can be prepared by polymerizing a monomer containing polymerization reactive groups having preferably two or more of polymerizing functional groups, together with a monomer containing functional group(s) capable of producing carboxyl group(s) through decomposition; or by copolymerizing a monomer containing two or more polymerizing functional groups and a monomer containing carboxyl group(s), and then protecting the carboxyl group(s) in a manner as described above.

Specific examples of polymerizing functional groups include $CH_2=CH-$, $CH_2=CH-CH_2-$, $CH_2=CH-COO-$, $CH_2=C(CH_3)-COO-$, $CH_3CH=CH-COO-$, $CH_2=CH-CONH-$, $CH_2=C(CH_3)-CONH-$, $CH_3CH=CH-CONH-$, $CH_2=CH-OCO-$, $CH_2=C(CH_3)-OCO-$, $CH_2=CH-CH_2-OCO-$, $CH_2=CH-NHCO-$, $CH_2=CH-CH_2-NHCO-$, $CH_2=CH-SO_2-$, $CH_2=CH-CO-$, $CH_2=CH-O-$, $CH_2=CH-S-$, etc.

The two or more polymerizing functional groups contained in the above-described monomers may be either the same or different selected from the above-cited groups to form polymers insoluble in nonaqueous solvents through polymerization.

Specific examples of monomers containing two or more of polymerizing functional groups of the same kind include styrene derivatives such as divinylbenzene, trivinylbenzene, etc.; methacrylic acrylic or crotonic acid esters, vinyl ethers or ally ethers of polyhydric alcohols (e.g., ethylene glycol, diethylene glycol, triethylene glycol, polyethylene glycol #200, #400, #600, 1,3-butylene glycol, neopentyl glycol, dipropylene glycol, polypropylene glycol, trimethylolpropane, trimethylolethane, pentaerythritol) or polyhydroxyphenols (e.g., hydroquinone, resorcine, catechol and their derivatives); vinyl esters, ally esters, vinyl amides or allyl amides of dibasic acids (e.g., malonic acid, succinic acid, glutaric acid, adipic acid, pimelic acid, maleic acid, phthalic acid, itaconic acid); condensates of polyamines (e.g., ethylenediamine, 1,3-propylenediamine, 1,4-butylenediamine) and carboxylic acids containing a vinyl group (e.g., methacrylic acid, acrylic acid, crotonic acid, allylacetic acid); etc.

Specific examples of monomers containing two or more different kinds of polymerizing functional groups include vinyl group-containing ester or amide derivatives of vinyl group-containing carboxylic acids (e.g., methacrylic acid, acrylic acid, methacryloylacetic acid, acryloylacetic acid, methacryloylpropionic acid, acryloylpropionic acid, itaconyloylacetaic acid, itaconyloypropionic acid, reaction products of carboxylic acid anhydrides and alcohols or amines (such as allyloxycarbonylpropionic acid, allyoxycarbonylacetic acid, 2-allyloxycarbonylbenzoic acid, allylaminocarbonylpropionic acid)), with specific examples including vinylmethacrylate, vinylacrylate, vinylitaconate, allylmethacrylate, allylacrylate, allylitaconate, vinylmethacryloylacetate, vinylmethacryloylpropionate, allylmethacryloylpropionate, vinyloxycarbonylmethylmethacrylate, vinyloxycarbonylmethyloxycarbonylethylene acrylate, N-allylacrylamide, N-allylitaconic acid amide, methacryloylpropionic acid allyl amide, and so on; and condensates of aminoalcohols (e.g., aminoethanol, 1-aminopropanol, 1-aminobutanol, 1-aminohexanol, 2-aminobutanol) and vinyl-containing carboxylic acids.

The resins of the present invention are formed through polymerization using the above-described monomers containing two or more of polymerizing functional groups in a proportion of about 0.1 to about 10% by weight, preferably 0.5 to 5% by weight, based on the total monomers..

On the other hand, resins containing cross-linking functional groups capable of undergoing a curing reaction by heat and/or light together with the foregoing carboxyl group-producing functional groups can be used as resin binder in the present invention, and a cross-linking structure may be formed therein at the subsequent stage of producing a plate precursor.

The above-described cross-linking functional group may be any of those capable of forming a chemical bond by undergoing a chemical reaction between molecules. More specifically, a usable mode of the chemical reaction involves causing the intermolecular bonding through a condensation reaction, addition reaction or so on, or the cross-linking through polymerization by application of heat and/or light. Specific examples of such functional groups include those containing at least one combination of a dissociable hydrogen-containing functional group (e.g., —COOH,

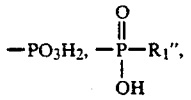

wherein $R_1''$ represents the same hydrocarbon residue as described in regard to $R_1$ to $R_3$ in the foregoing formula (I), or $—OR_1'''$ (wherein $R_1'''$ has the same meaning as $R_1''$), —OH, —SH, $—NHR_2''$ (wherein $R_2''$ represents a hydrogen atom, or an alkyl group containing 1 to 4 carbon atoms, e.g., methyl, ethyl, propyl, butyl, etc.) and a functional group selected from among

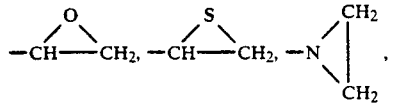

—NCO, —NCS and cyclic dicarboxylic acid anhydrides; $—CONHCH_2OR_3''$ (wherein $R_3''$ represents a hydrogen atom or an alkyl group containing 1 to 6 carbon atoms, e.g., methyl, ethyl, propyl, butyl, hexyl, etc.); and polymerizing double bond-containing groups.

Specific examples of polymerizing double bond-containing groups include those cited as specific examples of the foregoing polymerizing functional groups.

In addition, other functional groups and compounds can be used as cited in Goh Endo, *Netsukokasei Kobunshi no Seimitsuka*, C.M.C. K.K. (1986), Yuji Harasaki, *Saishin Binder Gijutsu Binran*, chap. II-1, Sogo Gijutsu Center (1985), Takayuki Otsu, *Acryl Jushi no Gosei Sekkei to Shin-Yoto Kaihatsu*, Chubu Keiei Kaihatsu Center Shuppanbu (1985), Eizo Ohmori, *Kinosei Akuriru-kei Jushi*, Techno System (1985), Hideo Inui & Gentaro Nagamatsu, Kenkosei Kobunshi, Kodansha (1977), Takahiro Tsunoda, *Shin-Kankosei Jushi*, Insatsu Gakkai Shuppanbu (1981), G. E. Green & B. P. Star, *J. Macro. Sci. Revs. Macro. Chem.*, C21(2), pp. 187–273 (1981–82), C.G. Roffey, *Photopolymerization of Surface Coatings*, A. Wiley Interscience Pub. (1982), and so on.

These cross-linking functional groups and carboxyl group-producing functional groups may be contained together in the same copolymer constituent, or separately in different copolymer constituents.

Monomers which correspond to copolymer constituents containing cross-linking functional groups as described above may be e.g., any of the vinyl compounds containing functional groups which are copolymerizable with the groups of the foregoing general formula (II).

Such vinyl compounds are described, e.g., in KobunshiGakkai (High Molecular Society) (editor), *Kobunshi (High Molecular) Data Handbook (Kiso-hen (Basic Volume))*, Baihukan (1986). Specific examples of these vinyl compounds include acrylic acid, α- and/or β-substituted acrylic acids (e.g., α-acetoxyacrylic acid, α-acetoxymethylacrylic acid, α-(2-aminomethylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acids (e.g., 2-pentenic acid, 2-methyl-2-hexenic acid, 2-octenic acid), maleic acid, maleic acid half esters, maleic acid half amide, vinylbenzenecarboxylic acid, vinylsulfonic acid, vinylphosphonic acid, vinyl or allyl half ester derivatives of dicarboxylic acids, and ester or amide derivatives of these carboxylic or sulfonic acids containing the foregoing cross-linking functional groups in their substituents.

A preferred fraction of "the cross-linking functional group-containing copolymer constituent" in the resin of this invention ranges preferably from 1 to 80 wt %, and particularly from 5 to 50 wt %.

To these resins, a reaction accelerator may be added, if desired, for accelerating the cross-linking reaction. Examples of accelerators for the cross-linking reaction include acetic acid, propionic acid, butyric acid, benzenesulfonic acid, p-toluenesulfonic acid, peroxides, azobis compounds, cross-linking agents, sensitizers, photopolymerizing monomers, etc. For example, the compounds described in Shinzo Yamashita & Tosuke Kaneko. *Kakyozai (Cross-Linking Agents) Handbook*, Taiseisha (1981) can be employed as cross linking agents. More specifically, cross linking agents such as organic silanes, polyurethanes, polyisocyanates and so on, and curing agents such as epoxy resins, melamine resin and so on can be employed.

In the case of light cross-linkable functional groups, compounds cited as examples in the foregoing publications concerning light-sensitive resins can be used.

When the resins containing cross-linking functional groups are used, the cross-linking in at least part of polymers can be carried out in the process of forming a photoconductive layer, or upon heating and/or optical exposure prior to etching. Usually, a heat curing processing is preferred, and effected by strictly controlling the drying condition for production of conventional photoreceptors. For instance, the heat curing may be carried out at 60° to 120° C. for 5 to 120 minutes. When the curing processing is carried out in the presence of the above-described reaction accelerators, more gentle conditions can be employed.

Also, conventional resins can be used together with the resins of the present invention. Examples of those conventional resins include silicone resins, alkyd resins, vinyl acetate resins, polyester resins, styrenebutadiene resins, acryl resins, etc., and more specifically, known materials as cited e.g., in Ryuji Kurita & Jiro Ishiwatari, *Kobunshi,* Vol. 17, p. 278 (1968), Harumi Miyamoto & Hidehiko Takei, *Imaging,* No. 8, p. 9 (1973).

The resins of the present invention and conventional resins can be blended in an arbitrary ratio, provided that the content of carboxyl group-producing functional group containing component in the total amount of the resins ranges from 0.5 to 95 wt %, particularly from 1 to 85 wt %, and more preferably from 30 to 85 wt %.

Since carboxyl groups are converted to protected functional groups in the resins of the present invention, interaction with zinc oxide particles is minimized. In addition, the carboxyl groups which are hydrophilic groups produced by an oil-desensitizing treatment further enhance the affinity of the nonimage part for water.

Moreover, in the plate precursor, though they become a soluble in water by release of carboxyl groups in the oil-desensitizing treatment, the resins of the present invention prevent elution in the nonimage part due to the presence of a cross-linking structure in at least part of the polymer, while sufficient affinity for water is retained.

Accordingly, the affinity of the nonimage part for water is further enhanced by the carboxyl groups produced in the resin, and the durability of the plate is also improved.

The effect of enhancing the affinity for water can be maintained as usual even when the proportion of carboxyl group-producing functional group-containing resins to whole binder resins is reduced. A large number of clear prints free from background stains can be obtained even when a large-sized printing machine is used, or printing conditions including fluctuation of printing pressure are severe.

In the lithographic printing plate precursor of this invention, all the above-described resin binders are used in an amount of from 10 to 60 parts by weight, preferably 15 to 40 parts by weight, per 100 parts by weight of photoconductive zinc oxide.

In this invention, various kinds of dyes can be used together with the photoconductive zinc oxide as spectral sensitizers, if desired. Specific examples of such spectral sensitizers are carbonium type dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes) and metal free- or metallo-phthalo cyanine dyes, as described, for example, in Harumi Miyamoto & Hidehiko Takei, *Imaging,* No. 8, p. 12 (1973), C. J. Young, et al, *RCA Review,* Vol. 15, p. 469 (1954), Kohei Kiyota, *Denkitsushin Gakkai Ronbun Shi* (*Journal of Telecommunication Society*), *J* 63-*C,* No. 2, p. 97 (1980), Yuji Harasaki, *Kogyo Kaqaku Zasshi* (*Journal of Industrial Chemistry*), Vol. 66, p. 78 and p. 188 (1963), Tadaaki Tani, *Nihon Shashin Gakkai Shi (Journal of The Society of Photographic Science and Technology of Japan,* Vol. 35, p. 208 (1972).

More specifically, dyes of carbonium type, triphenylmethane type, xanthene type and phthalein type, which are also used as spectral sensitizers are disclosed in JP-B-51-452, JP-A-50-90334, JP-A-50-114227, JP-A-53-39130, JP-A-53-82353, U.S. Pat. No. 3,052,540, U.S. Pat. No. 4,054,450, JP-A-57-16456, and so on.

Polymethine dyes including oxonol dyes, merocyanine dyes, cyanine dyes, rhodacyanine dyes and the like, for use in the present invention, are described in F. M. Harmmer, *The Cyanine Dyes and Related Compound.* More specifically, such dyes include those disclosed in U.S. Pat. Nos. 3,047,384, 3,110,591, 3,121,008, 3,125,447, 3,128,179, 3,132,942 and 3,622,317, British Patents 1,226,892, 1,309,274 and 1,405,898, JP-B-48-7814, JP-B-55-18892, etc.

Moreover, specific examples of polymethine dyes spectrally sensitizing the near infrared to infrared regions of wavelengths longer than 700 nm are disclosed in JP-A-47-840, JP-A-47-44180, JP-B-51-41061, JP A-49-5034, JP-A-49-45122, JP A-57-46245, JP-B-56-35141, JP-A-57-157254, JP-A-61-26044, JP-A-61-27551, U.S. Pat. Nos. 3,619,154 and 4,175,956, *Research Disclosure,* No. 216, pp. 117–118 (1982). The photoreceptor of this invention is superior in the respect that the combined use of various sensitizing dyes causes little fluctuation in electrophotographic properties (initial voltage, dark decay, light-sensitivity) and little fluctuation due to environmental conditions, in particular, moisture.

In addition, various known additives for electrophotographic photoreceptive layers, such as chemical sensitizers, etc., can be used, if needed. Examples of such additives include electron accepting compounds (e.g., halogens, benzoquinones, chloranil, acid anhydrides, organic carboxylic acids) as described in *Imaging,* No. 8, p. 12 (1973), and polyarylalkane compounds, hindered phenol compounds and p-phenylenediamine compounds as described in Hiroshi Komon, *Saikin no Kodendo Zairyo to Kankotai no Kaihatsu Jitsuvoka* (Recent Development and Practical Use of Photoconductive Materials and Photoreceptors), chaps. 4–6, Nippon Kagaku Joho K.K. Shuppanbu (1986).

There is no particular restriction on the addition amounts of these additives, but they are usually added in amounts ranging from 0.0001 to 2.0 parts by weight per 100 parts by weight of the photoconductive material used.

A preferred thickness of the photoconductive layer is from 1 to 100 microns, particularly from 10 to 50 microns.

When the photoconductive layer is used as a charge generating layer for an integrated type photoreceptor which comprises a charge generating layer and a charge transporting layer in combination, a thickness of the charge generating layer is preferably from 0.01 to 1 micron, particularly from 0.05 to 0.5 micron.

The photoconductive layer of this invention can be formed on a support of conventional use in the art. In general, the support for the electrophotographic photoreceptive layer is preferably electrically conductive.

Conductive supports which can be used in the present invention include the same ones as used in conventional photoreceptors, e.g., metals, base materials (such as paper and plastic sheets) to which electric conductivity is imparted by impregnation with a low resistance material, base materials the back surface (or the surface opposite to what has thereon a photoreceptive layer) of which is rendered conductive and further coated with at least one layer for the purpose of prevention of curling, the aforesaid supports which further have a waterproofing adhesive layer on the surface thereof, the aforesaid supports which further have one or more (if desired) pre coats, papers laminated with an Al-evaporated conductive plastic film or the like, etc.

More specifically, conductive materials for use in the present invention are described in Yukio Sakamoto, *Denshi Shashin* (*Electrophotoqraphy*), Vol. 14, No. 1, pp. 2–11 (1975), Hiroyuki Moriga, *Nyumon Tokushushi no Kagaku* (*Introduction to Chemistry of Specific Papers*), Kobunshi Kanko Kai (1975), M. F. Hoover, *J. Macromol. Sci. Chem.*, A-4 (6), pp. 1327–1417 (1970), etc.

The production of a printing plate from the lithographic printing plate precursor of the present invention can be carried out by a conventional procedure. The solution which can be used for the oil-desensitization treatment are well known in the art as described in, for example, JP-B-47-32681, JP-B-55-9315, JP-B-46-21244, JP-B-46-7106, JP-A-52-502, JP-B-45-24609, JP-A-57-2796, JP-A-57-20394, JP-A-53-83807, JP-A-53-109701, JP-A-52-126302, JP-B-40-763, JP-B-47-29642, JP-B-43-28404, JP-A-51-118501, etc.

More specifically, the oil-desensitizing solution in an aqueous solution comprising an agent which renders the non-image are hydrophilic as a main component, and other various additives such as a pH-adjusting agent, a buffering agent, etc. The hydrophilicity-providing agent can be any of conventionally known agents used for this purpose, for example, ferrocyanides and phosphates, phytic acid salts, aqueous polymers having a chelating ability, metal complexes, etc. The pH-adjusting agents are buffering agents can be any of known inorganic acids, organic acids or salts thereof, alone or as a mixture thereof. Examples of such agents include formic acid, acetic acid, butyric acid, valeric acid, lactic acid, tartaric acid, propionic acid, oxalic acid, malonic acid, succinic acid, glutaric acid, maleic acid, phthalic acid, citraconic acid, itaconic acid, fumaric acid, tricarboxylic acid, glycolic acid, thioglycolic acid, malic acid, citric acid, gluconic acid, pilvic acid, glycollic acid, salicylic acid, adipic acid, hydroacrylic acid, glyceric acid, p-toluenesulfonic acid and their metal salts and organic amine salts.

Further, when the main agent of the oil-desensitizing solution is a ferrocyanide, a chelating agent such as EDTA-2Na or a reducing agent such as a sulfite can be preferably added to the oil-desensitizing solution in order to retain an ability to render hydrophilic and also to prevent precipitation.

Also, when the main agent of the oil-desensitizing solution is a phytic acid salt, it is preferred to add a water-soluble cationic polymer as described in JP-A-60-23099 and a lower molecular weight electrolyte to the solution in order to decrease the generation of stains.

In addition, a wetting agent or dampening agent can also be incorporated into the oil-desensitizing solution, and examples of such agents include ethylene glycol, diethylene glycol, triethylene glycol, polyethylene glycol, glycerin, gum arabic, carboxymethyl cellulose, acrylic polymers, benzyl alcohol, cyclohexyl alcohol, propargyl alcohol, methanol, ethanol, iso- and n-propyl alcohols, triethanolamine, etc.

Further, preservatives such as salicylic acid, phenol, phenol butyl p-benzoate, sodium dehydroacetate, 4-isothiazolon-3-one, and the like can be added to the oil-desensitizing solution.

Furthermore, anti-rusting agents such as sodium nitrite, dicyclohexylammonium nitrite, etc. can be added to the oil-desensitizing solution.

In the oil-desensitizing treatment used in the present invention, an additional treatment for rendering the resin binder of the present invention hydrophilic may be conducted before or after the treatment with the above oil-desensitizing solution. The above additional treatment can be effected with an aqueous acidic solution or an aqueous alkaline solution.

The aqueous acidic solution comprises the inorganic or organic acid or the salt thereof, alone or as a mixture thereof, as described for the oil-desensitizing solution, and the aqueous alkaline solution comprises an inorganic compound such as sodium hydroxide, ammonia, sodium bicarbonate, sodium carbonate, sodium sulfite, sodium bisulfite, ammonium bisulfite, etc. or an organic basic compound such as trimethylamine, pyridine, piperidine, morpholine, ethanolamine, triethanolamine, hydrazine, etc., alone or as a mixture thereof.

Either the above-described aqueous acidic or alkaline solution may contain a water-soluble organic solvent such as the alcohols as described above for the wetting agents or dampening agents, ketones such as acetone, methyl ethyl ketone, etc., ethers such as tetrahydrofuran, dioxane, trioxane, etc. Further, the solution may contains other additives as described for the oil-desensitizing solution.

The acidic compounds or basic compounds as main agents used for the treatment for rendering the resin binder hydrophilic are preferably contained in an amount of from about 0.1 to about 1 mol per liter of the treating solution. If the organic solvent in incorporated into the treating solution, it is preferably used in a proportion of about 5 to about 50% by volume based on the total volume of the treating solution.

The oil-desensitizing treatment can be carried out at a temperature of about 10° C. to about 50° C., preferably from 20° C. to 35° C., for a period of not longer than about 5 minutes. Upon subjecting the oil-desensitizing treatment, the carboxyl group-producing functional groups are converted into carboxyl groups by hydrolysis or hydrogenolysis.

This invention is illustrated in greater detail by reference to the following examples. However, the inventin is not limited to these examples.

EXAMPLE 1 AND COMPARATIVE EXAMPLES A AND B

A mixture of 60 g of ethyl methacrylate, 40 g of the monomer (i) having the structural formula shown below, 3 g of divinylbenzene and 300 g of toluene was heated to 75° C. in a stream of nitrogen, and then 1.0 g of 2,2'-azobisisobutyronitrile was added to the mixture. The resulting mixture was allowed to react for 8 hours to produce a copolymer. The thus obtained copolymer was designated (I), and had a weight average molecular weight of 100,000.

Monomer (i) (corresponding to the copolymer constituent of this Invention)

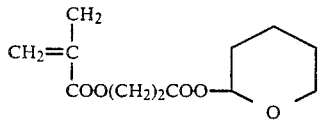

A mixture of 40 g (on a solids basis) of the copolymer (I), 200 g of zinc oxide, 0.05 g of Rose Bengale, 0.01 g of phthalic anhydride and 300 g of toluene was subjected to a dispersion processing in a ball mill for 2 hours to prepare a photoreceptive layer-forming composition. The composition was coated on a sheet of paper, which had received a conductive treatment, at a dry coverage of 25 g/m$^2$ using a wire bar. The coated paper was dried at 110° C. for 1 minute, and allowed to stand for 24 hours in the dark place under the condition of 20° C. 65% RH. Thus, an electrophotographic photoreceptor was obtained.

Photoreceptors A and B were prepared for comparison in the same manner as described above, except the following compositions were used in place of said photoreceptive layer-forming composition, respectively. Photoreceptor A for comparison:

A copolymer having a weight average molecular weight of 90,000 (designated A) was prepared in the same manner as the copolymer (I), except said mixture was replaced by a mixture composed of 60 g of ethylmethacrylate, 40 g of the monomer (i) and 300 g of toluene, the reaction temperature was changed to 60° C. from 75° C. and the amount of 2,2'-azobisisobutyronitrile added was changed to 0.5 g from 1.0 g. The photoreceptor A was produced in the same manner as the above-described photoreceptor of this invention, except said copolymer (I) was replaced by the copolymer A. Photoreceptor B for comparison:

The photoreceptor B was produced in the same manner as the above-described photoreceptor of this invention, except butylmethacrylate/acrylic acid (98/2 by weight) copolymer having a weight average molecular weight of 45,000 was used as a resin binder of the photoconductive layer in place of the copolymer (I).

These photoreceptors were examined for the filmsurface property (smoothness of the surface), the electrostatic characteristics, the oil-desensitivity of the photoconductive layer (expressed in terms of the contact angle of the oil-desensitized photoconductive layer with water), and the printing property (including background stains and printing durability). The printing property was determined as follows: Each photoreceptor was exposed and developed using an automatic camera processor ELP 404V (trademark for product of Fuji Photo Film Co., Ltd.) and a developer ELP-T (trademark for product of Fuji Photo Film Co., Ltd.) to form images, and etched with an etching processor using an oil-desensitizing solution ELP-E, resulting in conversion to a lithographic printing plate. The thus obtained printing plate was examined for the printing property (using Hamada Star Type 800SX (trademark for product of Hamada Star K.K.) as the printing machine).

The results obtained are shown in Table 1.

TABLE 1

| | Example 1 | Comparative Example A | Comparative Example B |
|---|---|---|---|
| Smoothness of Photocondutive Layer*1 (sec/cc) | 85 | 85 | 70 |
| Electrostatic characteristics*2 | | | |
| V ($V_o$) | 540 | 540 | 540 |
| $E_{1/10}$ (lux.sec) | 8.5 | 8.5 | 9.0 |
| Contact Angle With Water*3 (degree) | below 5 | below 5 | 15-28 (widely varied) |
| Property of Reproduced Image*4 | | | |
| I: Ordinary temperature and humidity | A | A | B |
| II: High temperature and humidity | A | A | D |
| Background Stain of Prints*5 | | | |
| I: | A | A | B |
| II: | More than 10,000 prints free from background stain | Background stain was generated from the 7000th print | Background stain was generated from the 1st print |

The terms shown in Table 1 were evaluated as follows.

*(1) Smoothness of Photoconductive layer:

The smoothness (sec/cc) of each photoreceptor was measured with a Beck smoothness tester (made by Kumagaya Riko K.K.) under a condition of air volume of 1 cc.

*(2) Electrostatic Characteristics:

After applying corona discharge of −6 KV onto the surface of each photoreceptor for 20 seconds using a paper analyzer (Paper Analyzer type SP-428, trademark for product made by Kawaguchi Denki K.K.) in a dark room kept at 20° C. and 65% RH, the photoreceptor was allowed to stand for 10 seconds, and then the surface potential ($V_o$) was measured. Subsequently, the surface of the photoconductive layer was exposed to visible light of 2.0 lux, and the time required for the surface potential to be reduced to 1/10 its starting value ($V_o$) was measured, and therefrom the exposure $E_{1/10}$ (lux.sec) was determined.

*(3) Contact Angle with Water:

After oil-desensitizing the surface of each photoconductive layer by passing each photoconductor once through an etching processor using an oil-desensitizing solution ELP-E (trademark for product of Fuji Photo Film Co., Ltd.), a drop of distilled water (2 micro liter) was put on the oil-desensitized surface, and the contact angle formed with the water drop was measured with a goniometer.

*(4) Property of Reproduced Image:

After allowing each photoreceptor and an automatic camera processor ELP 404V (trademark for product of Fuji Photo Film Co., Ltd.) to stand for 24 hours at ordinary temperature and humidity (20° C., 65% RH), the photoreceptor was processed with the foregoing automatic camera processor to form a reproduced image. The reproduced image on the printing plate precursor was observed with the naked eye to evaluate the property (including fog and image quality) (which is defined as the property I). The property II was evaluated in the same manner as the property I, except that the process was carried out under a high temperature and humidity condition (30° C., 80% RH).

*(5) Background Stain of Prints:

Each photoreceptor was processed with an automatic camera processor ELP 404V (trademark for product of Fuji Photo Film Co., Ltd.) to form a toner image thereon, and then oil-desensitized under the same conditions as in the case of the foregoing *(3). The thus obtained printing plate was installed as offset master in an offset printing machine (Hamada Star Type 800XS, made by Hamada Star K K.), and therewith the printing was performed on 500 sheets of wood free paper. Thus, background stains on all the prints was evaluated by the naked eye. These stains are defined as background stain I of the prints.

The background stain II of the prints was evaluated in the same manner as the background stain I, except the oil-desensitizing solution was diluted five times, the dampening solution used at the time of printing was diluted two times, and the printing pressure of the printing machine was rendered stronger. That is, the plate-making and printing conditions in the case of the background stain II are more severe than those in the case of the background stain I.

The ranks used for evaluating the property of reproduced image and background stain of prints are as follows:

Image Quality

A: Clear image without background stains

B: Slight background stains

C: Fairly amount of background stains and deficiency in fine lines of the reproduced letters D: Remarkable background stains, decreased density in the image area, and apparent deficiency in the reproduced letter Background Stains of Prints A: No stains B: Slight spot-like stains As can be seen from the data shown in Table 1, the reproduced images obtained by using the photoreceptor of this invention and the comparative photoreceptor A were all clear, while those obtained from the comparative photoreceptor B were unclear because of considerable deterioration of the smoothness of the photoconductive layer surface and generation of much fog in the nonimage part.

When each photoreceptor was processed under the 30° C. and 80% RH condition, only the reproduced images obtained in the comparative examples B had very low qualities (generation of background fog, and image densities of below 0.6).

As for the contact angle of the oil-desensitized photoreceptor with water, those in this example and the comparative example A were less than 5°, which indicated that the surface of the non-image part was rendered sufficiently hydrophilic only in this example and the comparative example A.

Further, when printing was practiced using the processed photoreceptors as master plate for offset printing, only the plates produced in this example and the comparative example A caused no background stain in the non-image part. Furthermore, when printing was continued using both plates under the more severe condition, including higher printing pressure, until 10,000 sheets of prints were obtained, the 10,000th print obtained using the plate of this example had good image quality and no background stain, while the plate of the comparative example A caused background stain in the 7,000th print. On the other hand, the plate of the comparative example B caused background stain even in the first print.

In conclusion, only the photoreceptor of this invention was able to always reproduce clear images even when processed under fluctuating conditions, and to provide not less than 10,000 sheets of background stain-free prints.

EXAMPLES 2 TO 14

Electrophotographic photoreceptors were prepared in the same manner as in Example 1, except the copolymers set forth in Table 2 were used in place of the copolymer (I) as the resin binder of this invention, respectively.

TABLE 2

| Example No. | Resin | Monomers corresponding to constituents of the copolymer of this invention: 75 wt % | 25 wt % | 1.5 wt % |
|---|---|---|---|---|
| 2 | (II) | 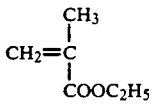 | 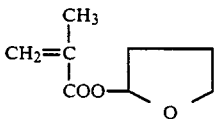 | 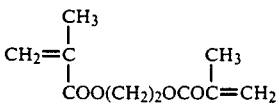 |
| 3 | (III) | " | 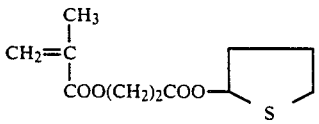 | 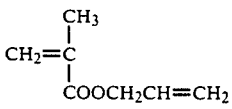 |
| 4 | (IV) | 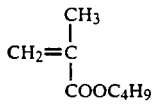 | 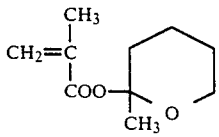 | 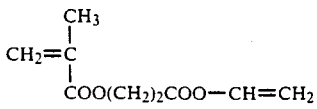 |

TABLE 2-continued

| Example No. | Resin | Monomers corresponding to constituents of the copolymer of this invention: 75 wt % | 25 wt % | 1.5 wt % |
|---|---|---|---|---|
| 5 | (V) | $CH_2{=}C(CH_3)COOC_2H_5$ | $CH_2{=}C(CH_3)COO{-}Si(CH_3)_2{-}C_4H_9$ | $CH_2{=}CH{-}OCO(CH_2)_6COO{-}CH{=}CH_2$ |
| 6 | (VI) | " | $CH_2{=}C(CH_3)COO{-}Si(C_3H_7)_3$ | $CH_2{=}C(CH_3)COO(CH_2O)_2COC(CH_3){=}CH_2$ |
| 7 | (VII) | $CH_2{=}C(CH_3)COOC_4H_9$ | $CH_2{=}C(CH_3)COOCH_2CF_3$ | $CH_2{=}CH$ 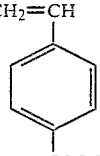 $COOCH_2CH{=}CH_2$ |
| 8 | (VIII) | $CH_2{=}C(CH_3)COOC_4H_7$ | $CH_2{=}CH{-}COOCH(CF_3)_2$ | $CH_2{=}CH{-}CONH(CH_2)_4OCO{-}CH{=}CH_2$ |
| 9 | (IX) | $CH_2{=}C(CH_3)COOC_2H_5$ | $CH_2{=}C(CH_3)COO$ 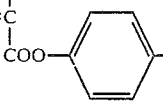 $CN$ | $(CH_2{=}C(CH_3){-}COOCH_2)_3{-}C{-}C_2H_5$ |
| 10 | (X) | $CH_2{=}C(CH_3)COOCH_2$ 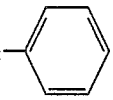 | $CH_2{=}C(CH_3)COOCH_2$ 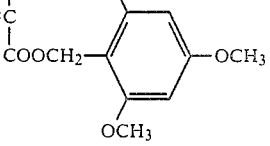 | $CH_2{=}CH$  $CH_2OCOCH{=}CH_2$ |
| 11 | (XI) | $CH_2{=}C(CH_3)COOC_4H_9$ | $CH_2{=}C(CH_3)COO(CH_2)_6COO{-}N$ 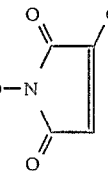 | $CH_2{=}C(CH_3)COO(CH_2)_3SO_2OCH_2CH{=}CH_2$ |
| 12 | (XII) | $CH_2{=}C(CH_3)COOC_2H_5$ | $CH_2{=}C(CH_3)COO(CH_2)_6CON$ 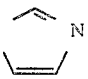 | $CH_2{=}CH{-}SO_2NH(CH_2)_2OCOCH{=}CH{-}CH_3$ |
| 13 | (XIII) | $CH_2{=}C(CH_3)COOC_4H_9$ | $CH_2{=}C(CH_3)COO(CH_2)_6CO{-}N$ 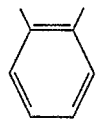 | $CH_2{=}C(CH_3){-}CH_3{-}COO(CH_2CH_2O)_2COC{=}CH_2$ |

TABLE 2-continued

| Example No. | Resin | Monomers corresponding to constituents of the copolymer of this invention: 75 wt % | 25 wt % | 1.5 wt % |
|---|---|---|---|---|
| 14 | (XIV) | 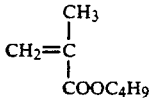 | 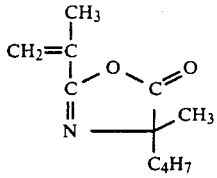 | 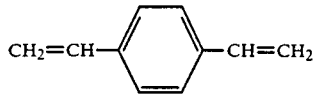 |

These electrophotographic photoreceptors were processed using the same apparatus as in Example 1. All of the obtained master plates for offset printing had a density of 1.0 or above, and all the image reproduced thereon were clear. After the etching processing, the printing was performed using each of the thus obtained printing plates and a printing machine to obtain more than 10,000 sheets of prints. Even after the printing operation was repeated 10,000 times, prints with fog-free, clear images were obtained.

On the other hand, the foregoing photoreceptors were allowed to stand under the 45° C. 75% RH condition for 2 weeks, and then processed in the same manner as described above. In this case, the same results as in the foregoing case, wherein the photoreceptors were not subjected to any ageing processing, were obtained.

EXAMPLE 15

A mixture of 62 g of benzyl methacrylate, 30 g of the monomer (ii) having the structural formula shown below, 8 g of N-methoxymethylmethacrylamide and 200 g of toluene was heated to 75° C. in a stream of nitrogen, and then 2 g of 2,2'-azobisisobutyronitrile was added thereto. The resulting mixture was allowed to react for 8 hours. Thereafter, it was heated up to 100° C., and further allowed to react for 2 hours. The thus obtained copolymer (named XV) had a weight average molecular weight of 95,000.

An electrophotographic photoreceptor was prepared in the same manner as in Example 1, except that the copolymer XV was used in place of the copolymer (I).

Monomer (ii) (corresponding to the copolymer constituent of this Invention)

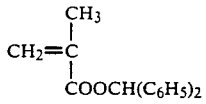

This photoreceptor was processed using the same automatic camera processor ELP 404V as in Example 1. The obtained master plate for offset printing had a density of 1.0 or above, and the image reproduced thereon was clear. After the etching processing, the printing was performed using the thus obtained printing plate and a printing machine. Even after the printing operation was repeated 10,000 times, prints with clear image and no fog in the non-image part were obtained.

EXAMPLE 16, 17 AND 18

Mixtures composed of the same ingredients as in Example 1, except that the copolymer (I) was replaced by the resins shown Table 3, respectively, were each dispersed in a ball mill for 2 hours. To each dispersion prepared, 8 g of allyl methacrylate and 1 g of 2,2'-azobis(2,4-dimethylvaleronitrile) were added, and further dispersed in the ball mill for 10 minutes to prepare a photoreceptive layer-forming composition.

TABLE 3

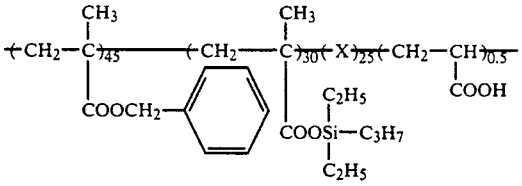

(fraction: by weight)

| Example No. | Resin | Chemical Structure of Copolymer Constituent X | Weight Average Molecular Weight |
|---|---|---|---|
| 16 | (XVI) | 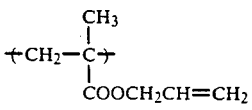 | 93,000 |
| 17 | (XVII) | 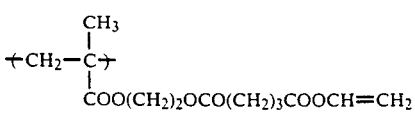 | 102,000 |

TABLE 3-continued

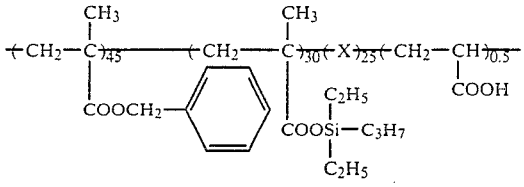

(fraction: by weight)

| Example No. | Resin | Chemical Structure of Copolymer Constituent X | Weight Average Molecular Weight |
|---|---|---|---|
| 18 | (XVIII) | $\leftarrow CH_2-CH \rightarrow$ (with side chain $COO(CH_2)_4COOCH_2CH{=}CH_2$) | 98,000 |

Each composition was coated on a sheet of paper, which had received a conductive treatment, at a dry coverage of 23 g/m$^2$ using a wire bar. Each coated paper was dried at 95° C. for 1.5 hours, and further at 110° C. for 1 minute. Thereafter, it was allowed to stand for 24 hours in the dark place under the condition of 20° C. and 65% RH. Thus, each of the desired electrophotographic photoreceptors was obtained These electrophotographic photoreceptors were processed using the same automatic camera processor ELP 404V as in Example 1. All of the thus obtained master plates for offset printing had a density of 1.2 or above, and all the images reproduced thereon were clear. After the etching processing, the printing was performed using each of the thus obtained printing plates and a printing machine to obtain more than 10,000 sheets of prints. Even after the printing operation was repeated 10,000 times, prints with clear image and no fog in the non-image area were obtined.

On the other hand, the foregoing photoreceptors were allowed to stand under the 45° C. and 75% RH condition for 2 weeks, and then processed in the same manner as described above. In this case also, the same results as in the case where the photoreceptors were not subjected to any aging processing were obtained

EXAMPLE 19

A mixture composed of 25 g of the copolymer (XIX) of this invention, whose structural formula is illustrated below, 200 g of zinc oxide, 0.05 g of Rose Bengale, 0.01 g of maleic anhydride and 300 g of toluene was subjected to a dispersion processing using a ball mill for 1.5 hours. Then, 15 g of the copolymer (XX) of this invention, whose structural formula is illustrated below, was further added thereto, and the mixture was dispersed using the ball mill for additional 5 hours. The thus prepared composition for forming a photoreceptive layer was coated and dried in the same manner as in Example 16 to produce a photoreceptor.

Copolymer (XIX) (weight average molecular weight: 40,000)

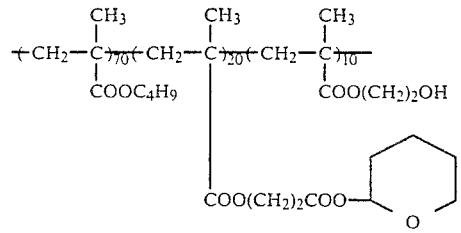

Copolymer (XX) (weight average molecular weight: 32,000)

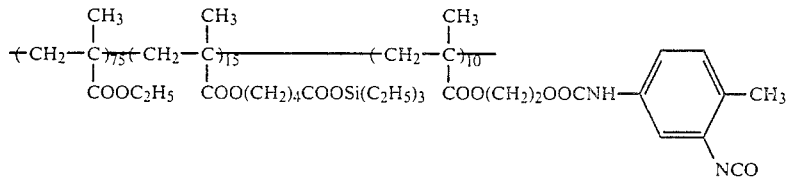

This electrophtographic photoreceptor was processed with the same apparatus as in Example 1, and then subjected to the etching treatment and the subsequent printing operation with a printing machine. The offset printing master plate obtained by the abovedescribed process had a density of 1.0 or above, and the image reproduced thereon was clear. In addition, even after the printing operation was repeated 10,000 times, prints with fog-free, clear image were obtained.

In accordance with this invention, electrophotographic lithographic printing plate precursors excellent in background stain resistance and printing durability were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor which utilizes an electrophotographic photoreceptor comprising a conductive support having provided thereon at least one photoconductive layer containing photoconductive zinc oxide and a resin binder, said resin binder comprising a partially cross-linked resin which contains at least one kind of functional group capable of producing at least one carboxyl group through decomposition, said cross-linking being sufficient to improve the stain resistance of the non-image area of the printing plate.

2. An electrophotographic lithographic printing plate precursor as in claim 1, wherein said resin is a resin of the kind which contains at least one copolymer constituent having at least one kind of functional group capable of producing at least one carboxyl group through decomposition, and has in advance such a cross-linking structure as to become slightly soluble or insoluble in water when the carboxyl groups are produced by the decomposition.

3. An electrophotographic lithographic printing plate precursor as in claim 1, wherein said resin is a resin containing at least one kind of functional group capable of producing at least one carboxyl group through decomposition and at least one kind of functional group capable of undergoing a curing reaction by heat or light.

4. An electrophotographic lithographic printing plate precursor as in claim 2, wherein said resin has a molecular weight of from $5\times10^3$ to $5\times10^5$.

5. An electrophotographic lithographic printing plate precursor as in claim 1, wherein said functional groups is contained in an amount of from about 1 to about 85 wt % based on the total weight of the resin binders.

6. An electrophotographic lithographic printing plate precursor as in claim 2, wherein said coplymer component having a cross-linking structure is present in an amount of from 0.1 to about 10 wt %, when the copolymer component contains polymerizable double bonds, or in an amount of from 1 to 80 wt %, when the copolymer component contains cross-linkable groups other than the polymerizable double bonds.

7. An electrophotographic lithographic printing plate precursor as in claim 1, wherein said resin is a resin containing at least one kind of functional group represented by formula (I):

$$-COO-L_1 \qquad (I)$$

wherein $L_1$ represents

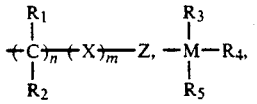

$-N=CH-Q_1$,

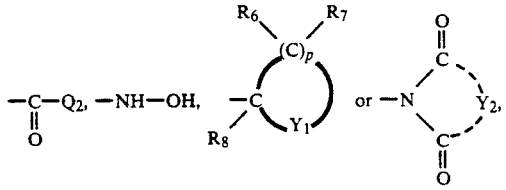

$R_1$ and $R_2$ each represents a hydrogen atom or an aliphatic group; X represents an aromatic group; Z represents a hydrogen atom, a halogen atom, a trihalomethyl group, an alkyl group, —CN, $-NO_2$, $-SO_2R_1$, (wherein $R_1$, represents a hydrocarbon group, $-COOR_2$, (wherein $R_2$, represents a hydrocarbon group), or $-O-R_3$, (wherein $R_3$, represents a hydrocarbon group); n and m are each 0, 1, or 2; $R_3$, $R_4$, and $R_5$ each represents a hydrocarbon group, or $-O-R_4$, (wherein $R_4$, represents a hydrocarbon group; M represents Si, Sn, Or Ti; $Q_1$ and $Q_2$ each represent a hydrocarbon group; $Y_1$ represents an oxygen atom, or a sulfur atom; $R_6$, $R_7$, and $R_8$ each represents a hydrogen atom, a hydrocarbon group, or $-O-R_5$, (wherein $R_5$, represents a hydrocarbon group); p represents an integer of 3 or 4; and $Y_2$ represents an organic residue to complete a cyclic imido group.

8. An electrophotographic lithographic printing plate precursor as in claim 1, wherein said resin is a resin containing at least one kind of functional group represented by formula (IV):

$$-CO-L_2 \qquad (IV)$$

wherein $L_2$ represents

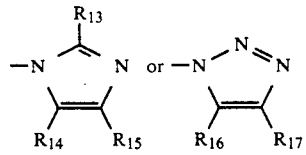

Wherein $R_{13}$, $R_{14}$, $R_{15}$, $R_{16}$ and $R_{17}$ each represents a hydrogen atom, or an aliphatic group.

9. An electrophotographic lithographic printing plate precursor as in claim 1, wherein said resin is a resin containing at least one kind of oxazolo ring represented by the formula (V):

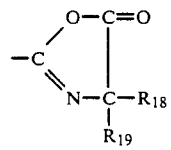

(V)

Wherein $R_{18}$ and $R_{19}$ each represents a hydrogen atom or a hydrocarbon group, or they may combine with each other to form a ring.

10. An electrophotographic lithographic printing plate precursor as in claim 1, wherein said partially cross-linked resin is one which is formed through polymerization using monomers containing two or more of polymerizing functional groups, said monomers containing two or more polymerizing functional groups being present in a proportion of from about 0.1 to about 10% by weight based on the total monomers.

11. An electrophotographic lithographic printing plate precursor as in claim 1, wherein said partially cross-linked resin is one which is formed by a cross-linking reaction in a polymer containing a cross-linking functional group-containing copolymer constitutent in an amount of from 1 to 80% by weight.

12. A process for forming an electrophotographic lithographic printing plate precursor, comprising:

(a) mixing photoconductive zinc oxide and a resin; and (b) coating the mixture of step (a) onto a conductive support to provide a photoconductive layer.

wherein said resin contains at least one kind of functional group capable of producing at least one carboxyl group through decomposition.

wherein said resin comprises a cross-linking functional group-containing copolymer constituent in an amount of from 1 to 80% by weight, and wherein said resin is partially cross-linked before step (a), after step (a), but before step (b), during step (b), after step (b), or during two or more of the above.

13. A process for forming an electrophotographic lithographic printing plate precursor, comprising:

(a) mixing photoconductive zinc oxide and a resin; and (b) coating the mixture of step (a) onto a conductive support to provide a photoconductive layer, wherein said resin contains at least one kind of functional group capable of producing at least one carboxyl group through decomposition, wherein said resin is formed by polymerizing monomers containing two or more of polymerizing functional groups, said monomers containing two or more polymerizing functional groups being present in a proportion of from about 0.1 to about 10% by weight based on the total monomers, and wherein said resin is partially cross-linked before step (a), after step (a), but before step (b), during step (b), after step (b), or during two or more of the above.

* * * * *